US006667452B2

(12) United States Patent
Spiegel

(10) Patent No.: US 6,667,452 B2
(45) Date of Patent: Dec. 23, 2003

(54) HIGH-VOLTAGE CIRCUIT-BREAKER HAVING A SPRING-LOADED CONTROL MECHANISM WITH AN ENERGY-RECOVERING ADDITIONAL SPRING

(75) Inventor: Hubert Spiegel, Oberentfelden (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/082,317

(22) Filed: Feb. 26, 2002

(65) Prior Publication Data

US 2002/0121503 A1 Sep. 5, 2002

(30) Foreign Application Priority Data

Mar. 1, 2001 (FR) ..... 01 02784

(51) Int. Cl.[7] ..... H01H 3/40
(52) U.S. Cl. ..... 200/501; 200/400
(58) Field of Search ..... 200/501, 400, 200/17 R, 401, 573–574, 337; 218/7, 14, 84, 92, 120, 140, 153, 154; 74/567–569

(56) References Cited

U.S. PATENT DOCUMENTS 4,228,333 A 10/1980 Kii
5,113,056 A * 5/1992 Kuhn ..... 200/400
5,541,378 A 7/1996 Niklaus
5,981,889 A * 11/1999 Niklaus ..... 200/501
6,066,820 A * 5/2000 Niklaus ..... 200/501

FOREIGN PATENT DOCUMENTS

| | | |
|---|---|---|
| DE | 756 085 C | 2/1953 |
| EP | 0 658 909 A1 | 6/1995 |
| FR | 2 398 378 A | 2/1979 |
| GB | 708 191 A | 4/1954 |

* cited by examiner

*Primary Examiner*—Elvin Enad
*Assistant Examiner*—M. Fishman
(74) *Attorney, Agent, or Firm*—Sughrue Mion, PLLC

(57) ABSTRACT

The electric circuit-breaker includes an interrupting chamber with at least one moving contact inside the chamber, the moving contact being actuated by means of a spring-loaded mechanical control mechanism so as to open or close the circuit-breaker. The control mechanism includes at least one first spring exerting a force tending to move the moving contact to open the circuit-breaker, and a second spring exerting a force tending to move the moving contact to close the circuit-breaker while loading the first spring. An additional spring is provided for exerting an additional force that is added to the force exerted by the first spring at the beginning of circuit-breaker opening. The additional spring thus accumulates some of the kinetic energy from the moving contact at the end of opening.

5 Claims, 2 Drawing Sheets

HIGH-VOLTAGE CIRCUIT-BREAKER HAVING A SPRING-LOADED CONTROL MECHANISM WITH AN ENERGY-RECOVERING ADDITIONAL SPRING

The invention relates to a high-voltage electric circuit-breaker, such as a compressed-gas puffer circuit-breaker including an interrupting chamber with at least one moving contact inside the chamber, the moving contact being actuated by means of a spring-loaded mechanical control mechanism so as to open or close the circuit-breaker, the control mechanism including at least one first spring exerting a force tending to move the moving contact to open the circuit-breaker, and a second spring exerting a force tending to move the moving contact to close the circuit-breaker while loading the first spring, and in which circuit-breaker an additional spring is provided for exerting an additional force that is added to the force exerted by the first spring at the beginning of circuit-breaker opening.

BACKGROUND OF THE INVENTION

Such a circuit-breaker is already known from U.S. Pat. No. 4,228,333. In the control device of that circuit-breaker, the additional spring contributes to increasing the speed at which the moving contact moves at the beginning of circuit-breaker opening. That additional spring ceases to exert the additional force once the moving contact has moved over a certain distance in its opening stroke, so as not to impede slowing down the moving contact at the end of circuit-breaker opening. But that configuration of the additional spring requires more energy to be delivered to the second spring in order to close the circuit-breaker, because it must load not only the first spring, but also the additional spring.

OBJECTS AND SUMMARY OF THE INVENTION

An object of the invention is to propose a particular configuration for a circuit-breaker as defined above, which configuration does not need additional energy to load the additional spring during circuit-breaker closure.

Another object of the invention is to provide a particular configuration for such a circuit-breaker that further makes it possible to recover and to store a portion of the kinetic energy from the moving contact at the end of opening or of closure, so as to use it at the beginning respectively of a subsequent closure operation or of a subsequent opening operation.

To this end, the invention provides an electric circuit-breaker including an interrupting chamber with at least one moving contact inside the chamber, the moving contact being actuated by means of a spring-loaded mechanical control mechanism so as to open or close the circuit-breaker, the control mechanism including at least one first spring exerting a force tending to move the moving contact to open the circuit-breaker, and a second spring exerting a force tending to move the moving contact to close the circuit-breaker while loading the first spring, and in which circuit-breaker an additional spring is provided for exerting an additional force that is added to the force exerted by the first spring at the beginning of circuit-breaker opening, wherein the additional spring is mounted so that, before the end of circuit-breaker opening, the resultant of the force exerted by the additional spring for moving the moving contact is reversed so as to oppose the movement of the moving contact.

Thus, at the end of circuit-breaker opening, the additional spring is loaded by the movement of the moving contact and it is thus not necessary to use a portion of the energy from the second spring of the control mechanism to re-load the additional spring during circuit-breaker closure. Since the moving contact moves essentially due to its own kinetic energy at the end of opening, the additional spring can serve to recover and store a portion of this kinetic energy which is otherwise consumed conventionally in a damper device.

In a particular embodiment, the control mechanism includes a rotary shaft movably coupled to the moving contact and rotated alternately by the first spring and by the second spring. The additional spring is coupled to the rotary shaft via a lever fixed to the rotary shaft and occupying two end angular positions corresponding to the positions of the moving contact when the circuit-breaker is respectively open or closed. The force exerted by the additional spring on the lever is oriented so that its rotational component changes direction when the lever goes through an intermediate angular position as it goes from one end angular position towards the other end angular position. Thus, the lever operates as a pendulum with the additional spring. At the beginning of opening, the resultant of the force exerted by the additional spring is added to the force exerted by the first spring, which tends to accelerate the speed at which the moving contact moves. At the beginning of circuit-breaker closure, the resultant of the force exerted by the additional spring is added to the force exerted by the second spring, so that it is possible to reduce the energy that is required for the control mechanism to engage the circuit-breaker.

In a particular embodiment of the circuit-breaker of the invention, the additional spring is coupled to the lever via a pulley, which makes it possible to dispose the additional spring in the vicinity of the interrupting chamber of the circuit-breaker so as to make the circuit-breaker more compact. This additional spring is preferably always loaded in compression.

In a particular embodiment of the circuit-breaker of the invention, the lever is a triangular-shaped lever or bell-crank that has one vertex that coincides with the rotary shaft and two other vertices coupled respectively to the moving contact and to the additional spring.

BRIEF DESCRIPTION OF THE DRAWINGS

An embodiment of a circuit-breaker of the invention is described in more detail below and is shown in the drawings, in which.

MORE DETAILED DESCRIPTION

Figure 1:
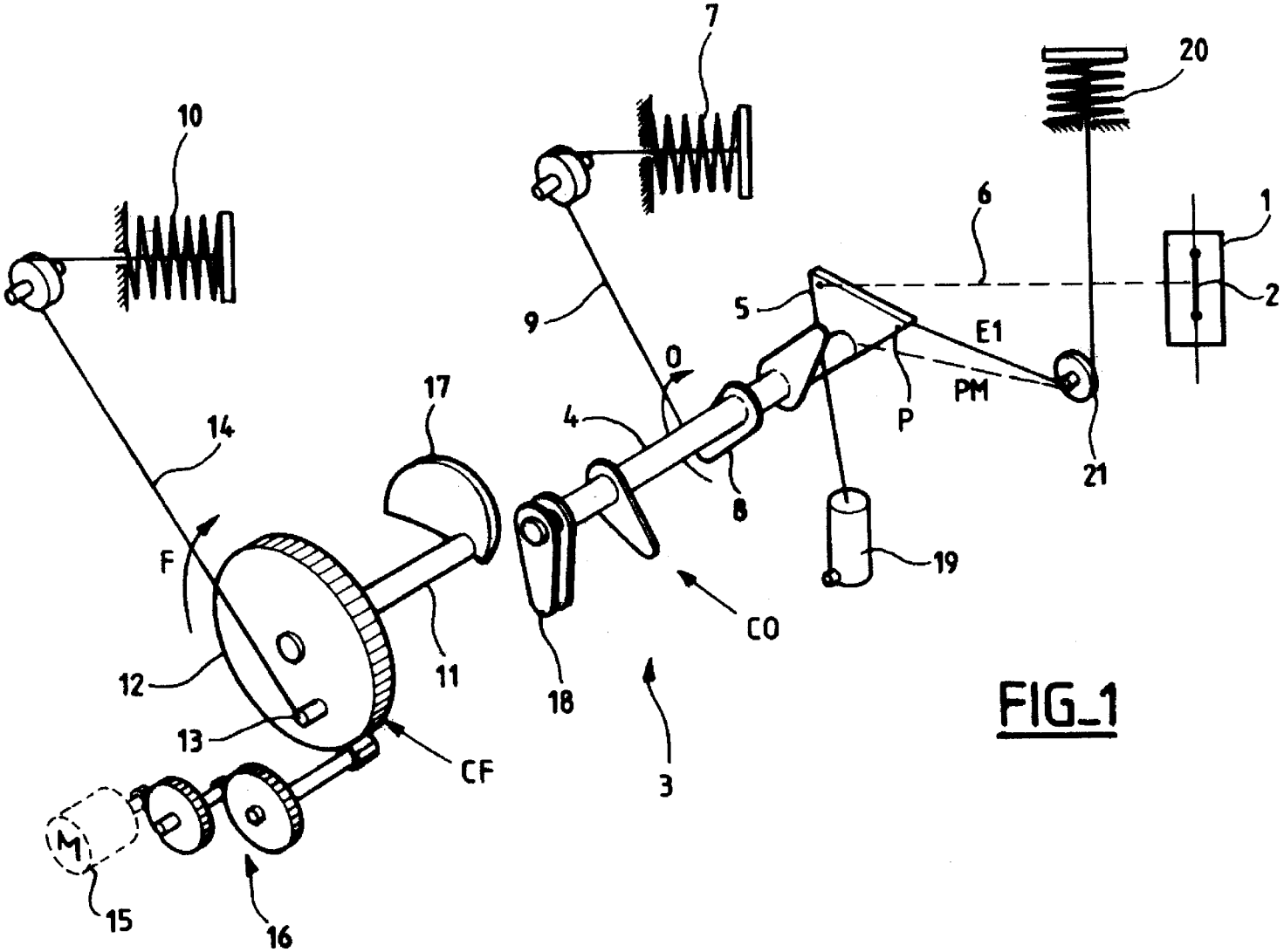
FIG. 1 is a very diagrammatic view of a circuit-breaker of the invention in the closed position.
Figure 2:
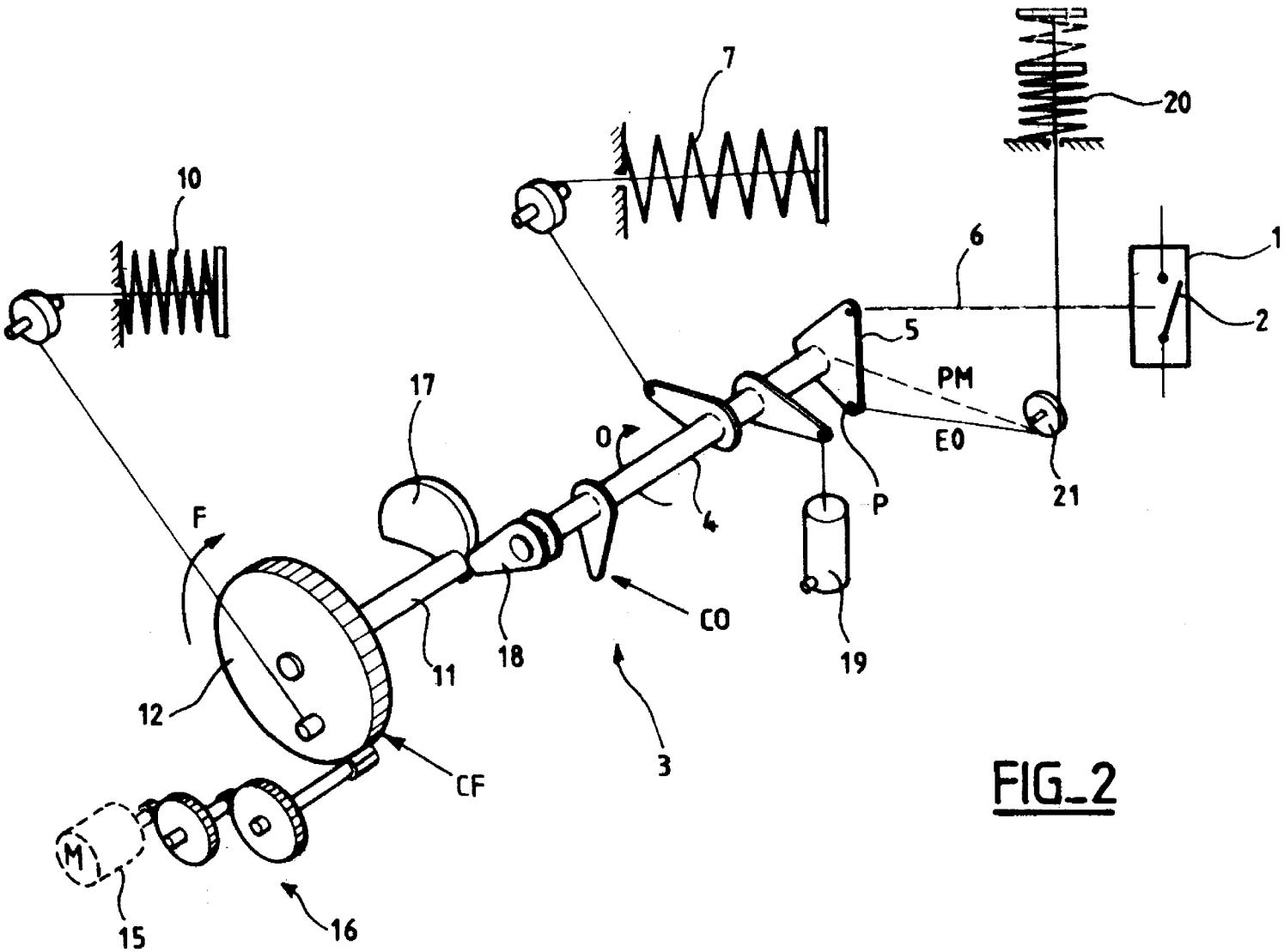
FIG. 2 is a very diagrammatic view of the FIG. 1 circuit-breaker shown in the open position.

In FIGS. 1 and 2, reference 1 designates an interrupting chamber of a circuit-breaker, e.g. a low-compression puffer interrupting chamber of an electric circuit-breaker. The interrupting chamber is generally filled with a dielectric gas, such as $SF_6$, under a pressure of a few bars.

Reference 2 designates a moving contact, e.g. a contact mounted to move in translation, in the interrupting chamber. The moving contact 2 is moved by a spring-loaded mechanical control mechanism 3 for opening or closing the circuit-breaker. In the example shown in the figures, the control mechanism 3 comprises in particular a main rotary shaft 4 which is fixed to a drive lever 5 that is coupled to the moving contact 2 via a hinged mechanical link 6 so that the rotary motion of the shaft 4 and thus of the lever 5 is transformed, e.g. into a movement in translation of the moving contact 2 in the chamber 1.

Reference 7 designates the disengagement spring of the control mechanism 3, which spring serves to open the circuit-breaker. The spring 7 acts on the shaft 4 via a lever 8 that is secured to the shaft 4 and via a chain 9 tensioned between the free end of the lever 8 and the spring 7. When the circuit-breaker is in the closed position, as shown in FIG. 1, the spring 7 is loaded and it exerts return torque on the lever 8 tending to rotate the shaft 4 in the direction indicated by arrow O. An unlockable disengagement catch CO is provided to prevent the shaft 4 from rotating when the circuit-breaker is closed. After a command to open the circuit-breaker has been given, the catch CO is unlocked, thereby causing the shaft 4 to rotate, and the lever 5 to be subjected to an angular movement which is transformed by the link 6 into a movement in translation of the moving contact 2.

The mechanical control mechanism 3 further comprises a system for closing the circuit-breaker, which system includes in particular a spring 10 acting on an engagement shaft 11 via a crank wheel 12 secured to the shaft 11. The crank wheel 12 is a toothed wheel which is provided with a crank pin 13 that is connected via a chain 14 to the spring 10. In this example, the crank wheel is coupled to an electric motor 15 via a gear train 16, the motor 15 serving to load the spring 10 after the circuit-breaker has been closed. The shaft 11 carries an engagement cam 17 itself engaged by a cam follower lever 18 that is secured to the shaft 4. When the engagement spring 10 is loaded, it exerts a return force on the wheel 12 tending to rotate the shaft 11 in the direction indicated by arrow F. An unlockable engagement catch CF is provided to prevent the engagement shaft 11 from rotating. After a command to close the circuit-breaker has been given, and starting from an open position as shown in FIG. 2, the catch CF is unlocked, thereby causing the shaft 11 to rotate, and causing the cam 17 to move angularly in the direction indicated by arrow F. The rotary motion of the cam 17 is transmitted to the cam follower lever 18, thereby causing the shaft 4 to rotate in the opposite direction to the direction indicated by arrow O. The spring 7, which was relaxed when the circuit-breaker was in the open position, is loaded once again when the circuit-breaker is closed, because of the shaft 4 rotating.

When the spring-loaded mechanical control mechanism is in its initial position, the two springs 7 and 10 are relaxed and the circuit-breaker is open. The wheel 12 being rotated by the motor 15 in the direction indicated by arrow F causes the spring 10 to be tensioned so that the control mechanism is then in the position shown in FIG. 2. The engagement catch CF is then released, and the spring 10 relaxes so as to exert return torque on the shaft 11 which is rotated in the direction indicated by arrow F. The shaft 11 rotating causes the engagement cam 17 to rotate, and the cam rotating then causes the cam follower lever 18 secured to the shaft 4 to rotate in the direction opposite to the direction O. The shaft 4 rotating tensions the spring 7 and causes the lever 5 to be subjected to an angular movement which is transformed into a movement in translation of the moving contact 2. The circuit-breaker is then closed and the shaft 4 is prevented from rotating by the disengagement catch CO. The spring 10 is then tensioned again by the motor 15 and the shaft 11 is prevented from rotating by the engagement catch CF. The control mechanism 3 is then in the position shown in FIG. 1. In this position, the control mechanism 3 is ready for a circuit-breaker opening-closing-opening sequence.

More particularly, after the disengagement catch CO is released, the spring 7 relaxes and exerts a return force that rotates the shaft 4 in the direction indicated by arrow O, thereby causing the moving contact 2 to move, resulting in the circuit-breaker being fully opened. The kinetic energy of the moving contact that remains available at the end of opening is consumed in a damper 19 coupled to the shaft 4. The circuit-breaker is closed again by unlocking the catch CF, thereby causing the spring 10 to relax, and the shaft 11 to rotate in the direction indicated by arrow F. The rotary motion of the shaft 11 is transmitted to the shaft 4 via the cam 17 and via the lever 18, but in the opposite direction, thereby simultaneously causing the moving contact 2 to move to a position in which the circuit-breaker is fully closed, and causing the spring 7 to be tensioned via the lever 8. The spring 10 is then tensioned again by means of the motor 15 as indicated above.

In the invention, an additional spring 20 is coupled to the shaft 4 so as to exert return torque on it, thereby contributing firstly to moving the moving contact at the beginning of circuit-breaker opening, and secondly to slowing down this movement at the end of opening. In particular, the spring 20 is coupled to the shaft 4 via the lever 5 which, in this example, is a triangular-shaped lever or bell-crank having one vertex coinciding with the shaft 4, and its two other vertices respectively coupled to the moving contact 2 and to the additional spring 20.

The vertex P of the lever 5 coupled to the spring 20 occupies two end angular positions corresponding to respective ones of the two positions of the moving contact 2 when the circuit-breaker is fully closed or fully open. When the lever 5 occupies one of its two end angular positions, the additional spring 20 is loaded to its maximum extent. In FIG. 1, the end angular position of the lever 5 that corresponds to the circuit-breaker being fully closed is indicated by reference E1, while the other end angular position of the lever 5, corresponding to the circuit-breaker being fully open, is indicated by E0 in FIG. 2. Typically, the angular stroke of the lever 5 and thus of the vertex P is about 60°. Regardless of the angular position of the lever 5, the force vector exerted by the spring always has the same direction because the spring 20 is always loaded, either under compression or under tension. Although the force exerted by the spring 20 always has the same direction, the resultant of the force exerts rotation torque on the shaft 4 and changes directions between the end positions E1 and E0. There is a intermediate angular position I (also referred to as the "dead center" position) in which the rotational component or resultant of the force exerted by the spring 20 on the lever 5 decreases to zero and then changes direction when the lever 5 is moved from one end angular position to the other end angular position. The return torque exerted by the spring 20 on the lever 5 and thus on the rotary shaft 4 is reversed on going through the dead center so that the lever 5 operates as a pendulum about this position. When the lever 5 occupies the dead center position PM, the additional spring 20 is relaxed to its maximum extent. The return force exerted by the spring 20 on the vertex P of the lever 5 then goes through the axis of rotation of the lever, i.e. through the axis of the rotary shaft 4, as shown in dashed lines in FIG. 2.

When the lever 5 moves from one end angular position to the other end position, during opening or closure, the spring 20 relaxes firstly until the lever 5 goes through its intermediate angular position PM. During this first angular displacement of the lever 5, the return torque exerted by the spring 20 on the rotary shaft 4 is added to the torque exerted by the spring 7 on the same shaft 4, and it contributes to rotating the shaft 4. After the lever 5 has gone through its dead center position, the spring 20 is progressively loaded because the return torque that it exerts on the lever 5 reverses. The spring 20 then opposes the angular movement of the lever 5 and thus opposes the movement of the moving contact 2.

The intermediate angular position of the lever 5 is chosen such that, while it is moving from its intermediate angular position PM to its end angular position E0 during circuit-breaker opening, the spring 2 accumulates and stores a portion of the kinetic energy from the moving contact that is normally consumed in the damper 19 at the end of opening. The energy stored in the spring 20 at the end of opening is restored at the beginning of the subsequent closure operation, and is added to the energy delivered by the spring 10 to rotate the shaft 4. Conversely, the energy stored by the spring 20 at the end of closure is restored at the beginning of the subsequent opening operation and is added to the energy delivered by the spring 7 for rotating the shaft 4.

With this construction, the additional spring 20 is loaded to its maximum extent at the end of each opening or closure operation, by means of the kinetic energy from the moving contact 2. Naturally, the spring 20 is calibrated suitably relative to the disengagement spring 7 and to the engagement spring 10 so that it can be loaded until the lever 5 takes up an end angular position.

Preferably, the spring 20 is disposed inside the mechanical control mechanism 3, and is coupled to the lever 5 by a chain engaged on a pulley 21. Such a configuration makes it possible to place the spring 20 in the vicinity of the interrupting chamber so as to make the circuit-breaker more compact. The lever 5 may also be coupled to the spring 20 by a hinged link.

What is claimed is:

1. An electric circuit-breaker including an interrupting chamber with at least one moving contact inside the chamber, the moving contact being actuated by means of a spring-loaded mechanical control mechanism so as to open or close the circuit-breaker, the control mechanism including at least one first spring exerting a force tending to move the moving contact to open the circuit-breaker, and a second spring exerting a force tending to move the moving contact to close the circuit-breaker while loading the first spring, and in which circuit-breaker an additional spring is provided for exerting an additional force that is added to the force exerted by the first spring at the beginning of circuit-breaker opening, wherein the additional spring is mounted so that, before the end of circuit-breaker opening, the resultant of the force exerted by the additional spring for moving the moving contact is reversed so as to oppose the movement of the moving contact.

2. The circuit-breaker according to claim 1, in which the control mechanism includes a rotary shaft movably coupled to the moving contact and rotated alternately by the first spring and by the second spring, and in which the additional spring is coupled to the rotary shaft via a lever fixed to the rotary shaft and occupying two end angular positions corresponding to the positions of the moving contact when the circuit-breaker is respectively open or closed, the force exerted by the additional spring on the lever being oriented so that its rotational component changes direction when the lever goes through an intermediate angular position as it goes from one end angular position towards the other end angular position.

3. The circuit-breaker according to claim 2, in which the additional spring is coupled to the lever via a pulley.

4. The circuit-breaker according to claim 3, in which the additional spring is loaded in compression.

5. The circuit-breaker according to claim 2, in which said lever is a triangular-shaped lever or bell-crank that has one vertex that coincides with the rotary shaft and two other vertices coupled respectively to the moving contact and to the additional spring.

* * * * *